US005454513A

United States Patent [19]

Wilson

[11] Patent Number: 5,454,513

[45] Date of Patent: Oct. 3, 1995

[54] TOY TRACK SECTION

[75] Inventor: Roy V. Wilson, Eagle, N.Y.

[73] Assignee: Learning Curve Toys, L.P., Chicago, Ill.

[21] Appl. No.: 214,408

[22] Filed: Mar. 16, 1994

[51] Int. Cl.[6] ..... E01B 23/00

[52] U.S. Cl. ..... 238/10 E

[58] Field of Search ..... 238/10 E, 10 R, 238/10 A, 10 B, 10 C, 10 F, 12

[56] References Cited

U.S. PATENT DOCUMENTS

| | | | |
|---|---|---|---|
| 2,401,468 | 6/1946 | Duffy | 238/10 E |
| 3,650,468 | 3/1972 | Ewe et al. | 238/10 E |
| 4,955,537 | 9/1990 | Bratovz | 238/10 E |

FOREIGN PATENT DOCUMENTS

| | | | |
|---|---|---|---|
| 0146951 | 4/1949 | Australia | 238/10 R |
| 0307505 | 1/1918 | Germany | 238/10 R |
| 0852356 | 8/1952 | Germany | 238/10 R |
| 0698893 | 10/1953 | United Kingdom | 238/10 R |
| 2139909 | 11/1984 | United Kingdom | 238/10 C |

*Primary Examiner*—Mark T. Le

[57] ABSTRACT

A toy track section comprises a body having an upper face, a pair of spaced, parallel rail members formed in the upper face, and a plurality of spaced discontinuities formed in at least one of the rail members, and preferably both. The rails and discontinuities are of a size and shape to permit wheels of a toy train to roll and be guided by the rail members while causing a repeating "clacking" sound to be emitted by the wheels rolling on the rail members, in a manner reminiscent of a full-sized, moving train.

13 Claims, 1 Drawing Sheet

TOY TRACK SECTION

BACKGROUND OF THE INVENTION

Toy tracks for trains and other moving vehicles are of course well known, being typically broken down between uses into a series of interconnecting track sections. Often, the track sections are made of metal, which is expensive, or molded plastic, which is often breakable. Also, many of the track and vehicle systems, particularly toy trains, lack realism.

In accordance with this invention, a new form of track is provided which is inexpensive, and may be made of a machined and/or stamped piece of wood or the like for easy manufacture and low cost. Also, by this invention toy trains or other vehicles that roll on the tracks made of sections in accordance with this invention can emit a "clacking" sound which can be quite reminiscent of actual moving railroad trains.

DESCRIPTION OF THE INVENTION

By this invention, a toy track section is provided which comprises a body having an upper face, a pair of spaced, parallel rail members formed in the upper face, and a plurality of spaced discontinuities formed in at least one of the rail members, and preferably both. The rails and the discontinuities are of a size and shape to permit the wheels of a toy train to roll and be guided by the rail members, while causing a repeating "clacking" sound to be emitted.

Preferably, the rail members comprise channels formed in the upper face so that the toy trains or other vehicles can roll on the tracks without requiring flanged wheels. Alternatively, the rail members may comprise elevated ribs if desired for vehicles with flanged wheels.

The discontinuities preferably comprise transverse wedge shaped grooves which are formed in the rail members to engage the wheels that roll on the rails. The transverse grooves are spaced so that a toy train, having wheels that fit with the rail members and which is moving at the expected speed, emits a characteristic "clacking" sound as the wheels engage each of the discontinuities, to sound like a real train as it moves along the tracks.

Alternatively, the discontinuities may be small elevations, to cause a similar "clacking" sound as toy trains and other toy vehicles roll along the tracks.

Each of the track sections has a pair of opposed ends which each define connector members, each for connection with another of the toy track sections with the respective rail members being held in abutting relation.

It is also preferable for the track sections of this invention to have an upper face which defines a plurality of spaced ribs extending perpendicular to the rail members, to simulate railroad ties. Thus, even though the preferred track sections utilize channels for rails rather than upwardly projecting rails, they still exhibit a significant resemblance to actual railroad track, which is enhanced by the sound that the toy train makes as the wheels engage the discontinuities on the rails.

It is preferred for the rail members and the discontinuities to be also formed on the face of the body which is opposed to the upper face. The ribs that simulate railroad ties may be formed there also. Thus, either side of the track sections may be used. This is particularly useful with respect to curved pieces and the like since such pieces may be used to define a curve in the track in either direction. Also tracks of different gauge may be defined on different sides.

The track sections of this invention may be manufactured by a process which comprises impressing of a die into the face of a body, made of a rigid, porous material such as wood, a pair of spaced, parallel rail members having a plurality of spaced discontinuities formed in at least one of the rail members and preferably both. The rails and discontinuities are preferably of the size and shape as described below, to permit the wheels of a toy train to roll and be guided by the rail members while causing the desirable "clacking" sound to simulate a train.

The track sections of this invention may of course also be used with any other vehicle that fits the rails, such as toy trucks, racing cars, and the like. The track sections may be curved or straight, and of any practical length. Also, they need not include the impression of rail members.

The above manufacturing method is simple. Since temperature is not critical, it is typically performed at room temperature. A pressing of the die simply imposes the desired pattern into one or both faces of a typically precut wooden track section. However, if desired, a porous plastic, a paper laminate, or the like may be similarly used to manufacture track sections in accordance with this invention.

DESCRIPTION OF SPECIFIC EMBODIMENTS

Figure 3:
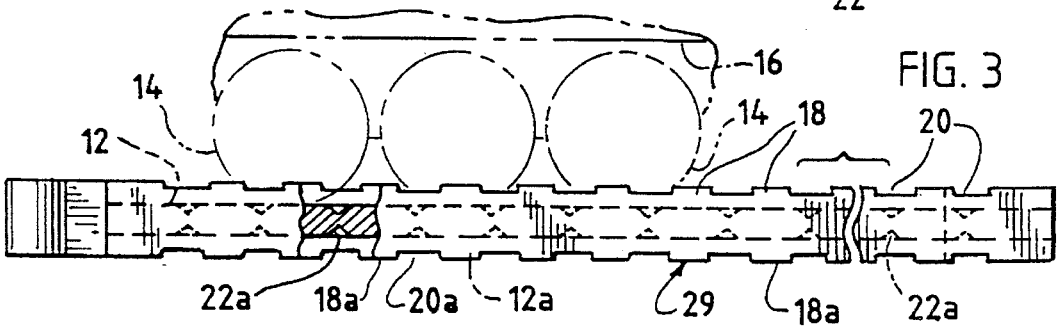
FIG. 3 is a side elevational view of the track section of FIG. 1.

Referring to the drawings, track section 10 is disclosed, being made in this embodiment out of a single piece of wooden board which has been precut by sawing into a blank of the shape shown. Each track section comprises a pair of spaced channels 12 which serve as the rails in which the wheels 14 of a toy rail car 16 can roll as shown in FIG. 3. Uniformly distributed, spaced ribs 18 project outwardly to give the impression of railroad ties.

The channels which define the rails 12 may be a quarter of an inch wide and an eighth of an inch deep. The spaced, perpendicular ribs 18 may actually be defined by the recess 20 between them, so that ribs 18 may be a quarter of an inch wide and 0.025 to 0.035 inches high, above recesses 20.

The spaced discontinuities of this invention are defined by wedged shaped indentations 22, which are impressed into the wood at the bottom of the rail-defining channels 12, and spaced about a half an inch apart. Thus, as the wheels 14 of a toy train roll along the rails 12, they emit a sound which is similar to the characteristic "clacking" of a real train rolling at high speed on its tracks. The indentations 22 may be spaced at any desired distance so that a toy train running at its contemplated speed makes the desired railroad sound in a realistic manner.

Toy track section 10 carries a track connector 24, 26 at each of its ends. As shown, connector 24 comprises an enlarged end extending member, while connector member 26 comprises a recess. Each of the connector members 24, 26 is proportioned to fit into the other connector 24, 26 of another, identical piece of track section 10 in a manner so that the respective rails 12 of the abutting track sections are held together in abutting relation. Thus, a complete track may be built in a manner which is per se broadly conventional.

Recess-type connector 26 may comprise bevelled portions 27 where it opens to the exterior along the plane of the track section. This facilitates assembly of the track sections and avoids breakage and splintering at that area.

Figure 2:
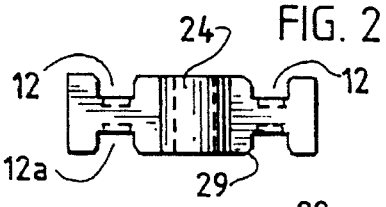
FIG. 2 is an end elevational view of the track section of this invention.
Figure 1:
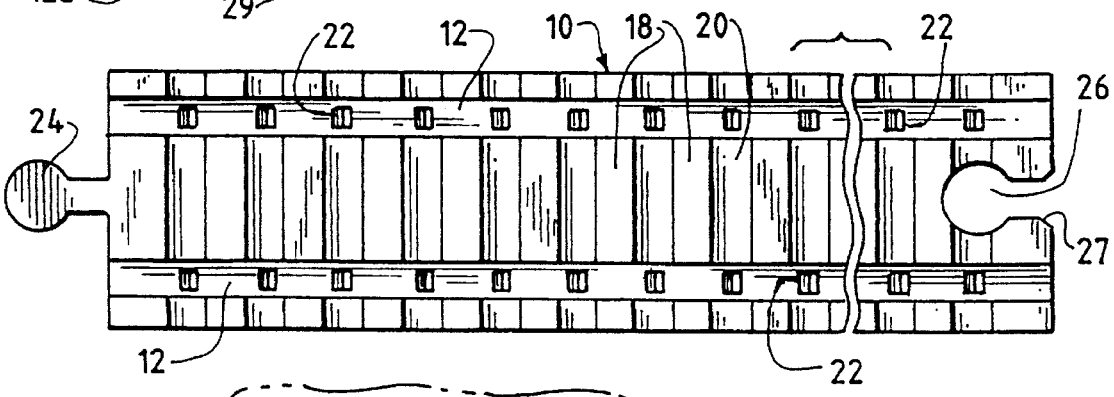
FIG. 1 is a plan view of a track section made in accordance with this invention.

It can be seen from FIGS. 2 and 3 that the face 29 of the track section which is opposed to the face shown in FIG. 1 may be of the same or similar design, having tracks 12*a*, cross ties 18*a*, and recesses 20*a*. Likewise corresponding discontinuities 22*a* may be formed at the bottoms of tracks 12*a*. If desired, the other side of each track section may comprise tracks of a different gauge to accommodate two different sizes of toy or the like. Also, on curved track sections which may be similar to the track section shown except for the curve, if the two sides are of identical design, the curved pieces may be used for right hand or left hand curves depending upon which side is up, for greater versatility of the design of an overall track system.

Thus, a track section is provided in accordance with this invention which may be easily assembled with other of such track sections into a track system which is inexpensive, easy to assemble and take apart, and which provides realism of railroad sounds combined with simplicity.

Figure 4:
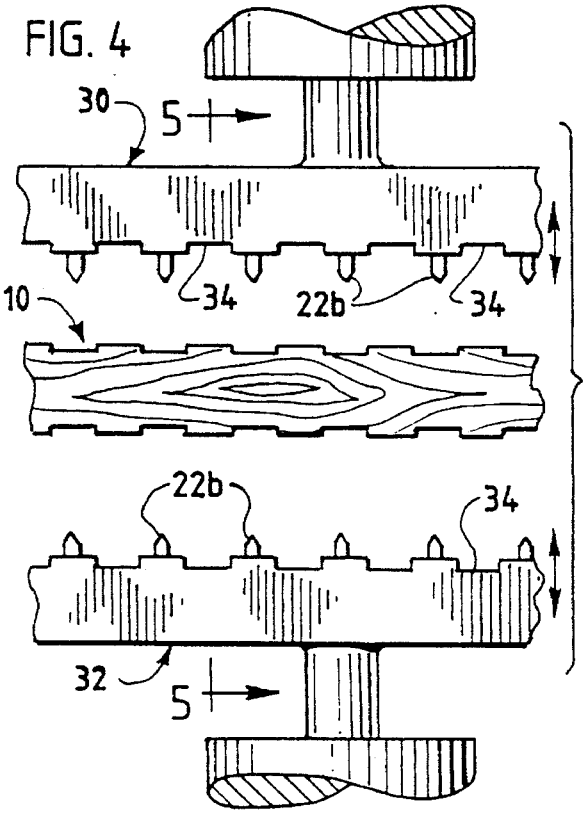
FIG. 4 is a schematic view showing how a track section blank may be impressed with a pair of dies in accordance with this invention to form the track section of FIGS. 1–3.
Figure 5:
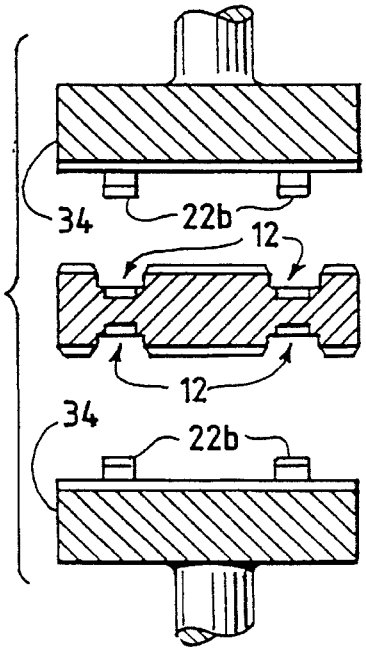
FIG. 5 is a sectional view taken along line 5—5 looking in the direction of the arrows in FIG. 4.

Referring to FIG. 4, track section 10 is shown, being made by stamping of both sides of a wooden blank which is precut to the overall configuration of track section 10. Then, pressing dies 30, 32, each having a profiled face 34, including a wedged shaped die 22*b* corresponding to the indentations 22 are pressed into the track section blank to form by such pressure the profiled faces of the major sides of each track section 10 and the indentations 22. For clarity, the section FIG. 5 shows an end view of the die in order that the die can impress each track section with the cross ties 18*a* and the indentations 22*a* as seen in FIGS. 1 and 2. This can be accomplished at substantially room temperature with rigid, porous materials, particularly many varieties of wood. The process represents a simple and rapid manufacturing technique.

The above has been offered for illustrative purposes only, and is not intended to limit the scope of the invention of this application, which is as defined in the claims below.

That which is claimed is:

1. A toy track section, which comprises a body having an upper face, a pair of spaced, parallel rail members comprising channels formed in said upper face, said channels each having a bottom surface, and a plurality of spaced discontinuities formed in at least one of the bottom surfaces of said channels, said channels and discontinuities being of a size and shape to permit wheels of a toy train to roll on and be guided by said channels while causing a repeating "clacking" sound to be emitted.

2. The track section of claim 1 in which said discontinuities comprise transverse grooves formed in said channels in positions to engage said wheels.

3. The track section of claim 1 in which said body has a pair of opposed ends which define connector members, each for connection with another of said toy track sections with the respective rail members held in abutting relation.

4. The track section of claim 1 which is made of a single piece of wood.

5. The track section of claim 1 in which said upper face defines a plurality of spaced ribs, extending transversely to said rail members, to simulate railroad ties.

6. The track section of claim 1 in which said rail members and discontinuities are also formed on the face of said body which is opposed to said upper face.

7. A toy track section, which comprises a body having an upper face, a pair of spaced, parallel rail members comprising channels formed in said upper face, each of said channels having a bottom surface, and a plurality of spaced discontinuities formed in at least one of the bottom surfaces of said channels, said channels and discontinuities being of a size and shape to permit wheels of a toy train to roll and be guided by said channels while causing a repeating "clacking" sound to be emitted, said upper face also defining a plurality of spaced ribs extending transversely to said rail members, to simulate railroad ties.

8. The track section of claim 7 in which said rail members, discontinuities, and spaced ribs are also formed on the face of said body which is opposed to said upper face.

9. The track section of claim 8 in which said discontinuities comprise transverse grooves formed in the channels defining said rail members in positions to engage said wheels.

10. The track section of claim 8 which is made of a single piece of wood.

11. A toy track section, which comprises a body having upper and lower faces, a pair of spaced, parallel rail members comprising channels formed in said upper face, and a plurality of spaced discontinuities formed in at least one of said rail members, said rail members and discontinuities being of a size and shape to permit wheels of a toy train to roll and be guided by said rail members while causing a repeating "clacking sound" to be emitted, said upper face also defining a plurality of spaced ribs extending transversely to said rail members, to simulate railroad ties, and further in which said rail members, discontinuities, and spaced ribs are also formed on the lower face of said body.

12. The track section of claim 11 in which said discontinuities comprise transverse grooves formed in the channels defining said rail members in positions to engage said wheels.

13. The track section of claim 12 which is made of a single piece of wood.

* * * * *